US005636446A

United States Patent [19]

Mae et al.

[11] Patent Number: 5,636,446

[45] Date of Patent: Jun. 10, 1997

[54] COMPONENT DRIER

[75] Inventors: Masataka Mae; Masaaki Okane, both of Kyoto, Japan

[73] Assignee: Murata Manufacturing Co., Ltd., Japan

[21] Appl. No.: 263,471

[22] Filed: Jun. 22, 1994

[30] Foreign Application Priority Data

Jun. 23, 1993 [JP] Japan ..... 5-152239

[51] Int. Cl.[6] ..... F26B 21/06

[52] U.S. Cl. ..... 34/76; 34/197; 34/195; 34/218

[58] Field of Search ..... 34/76, 210, 218, 34/195, 197, 406, 412, 468, 469

[56] References Cited

U.S. PATENT DOCUMENTS

| | | | |
|---|---|---|---|
| 560,561 | 5/1896 | Zappert | 34/406 |
| 763,388 | 6/1904 | Gathmann | 34/469 |
| 1,422,620 | 7/1922 | Power . | |
| 1,777,493 | 10/1930 | Jadin et al. | 34/197 |
| 4,715,129 | 12/1987 | Uchida | 34/195 |
| 5,048,201 | 9/1991 | Layton . | |

FOREIGN PATENT DOCUMENTS

| | | | |
|---|---|---|---|
| 1302183 | 7/1962 | France . | |
| 677371 | 6/1939 | Germany | 43/218 |
| 1871587 | 11/1962 | Germany . | |
| 64-2699 | 1/1989 | Japan . | |

*Primary Examiner*—F. Daniel Lopez

*Attorney, Agent, or Firm*—Ostrolenk, Faber, Gerb & Soffen, LLP

[57] ABSTRACT

A component drier for drying electronic components which are washed with solvent. The component drier includes a drying chamber, in which a vat having a bottom surface wall allowing passage of air and water is arranged. The vat stores components to be dried. Heated air is introduced into the drying chamber through an air inlet which is positioned above the vat. The air in the drying chamber is forcibly discharged through an air outlet which is positioned below the vat. Thus, a space under the vat has a sufficient negative pressure as compared with a space above the vat so that the air forcibly passes through clearances between the components downwardly from above the vat, thereby removing most part of the solvent moistening the components in the liquid state. A small quantity of liquid which is left on the components is subsequently efficiently vaporized by the heated air.

3 Claims, 2 Drawing Sheets

COMPONENT DRIER

BACKGROUND OF THE INVENTION

1. Field of the Invention

The present invention relates to a component drier which is employed for removing a liquid moistening surfaces of electronic components or the like, and more particularly, it relates to a suction type component drier.

2. Description of the Background Art

In relation to drying means for removing water moistening surfaces of electronic components such as multilayer capacitors, for example, having outermost layers of external electrodes which are covered with tin or solder plating films, for example, the following means have been employed in general:

FIG. 2 shows a conventional component drier 1 employing hot air, as first drying means. Referring to FIG. 2, the component drier 1 comprises a housing 2, a rack 3 which is provided in the housing 2, and a vat 5 which is arranged on the rack 3 for storing a plurality of components 4 to be dried. Further, a heater 6 is arranged in the housing 2 for generating hot air, which is fed into the housing 2 by a fan 7 along arrows. The housing 2 is provided with an openable/closable damper 8, for discharging moistened hot air.

The hot air moving along arrows is supplied to the components 4 which are stored in the vat 5, to successively dry the same from those located in a relatively upper portion of the vat 5.

On the other hand, second conventional drying means is implemented by a substitutional component drier which employs trichlorotrifluoroethane, serving as a moisture substituter, and a surface active agent, for substituting the same for water which is moistening components to be dried.

In the first conventional drying means shown in FIG. 2, however, those of the components 4 which are close to the bottom surface of the vat 5 are dried after those positioned in the upper portion of the vat 5. In this means, further, the water is so slowly vaporized that all impurities having been dissolved therein may be left on the surfaces of the dried components 4 to form spots, leading to inferior appearance of the components 4. In addition, electrodes which are exposed on the surfaces of the components 4 may be oxidized due to long-time drying under a high temperature, to exert a bad influence on solderability of the components 4.

Further, the hot air is merely supplied to the space surrounding the components 4 stored in the vat 5 is a manner that is so inferior in thermal efficiency that energy required for drying the components 4 is consumed in a relatively large quantity.

In the second drying means, on the other hand, employment of trichlorotrifluoroethane, which leads to destruction of the ozonosphere, is now being globally forbidden. Further, the surface active agent may remain on the components to leave spots on the surfaces thereof.

SUMMARY OF THE INVENTION

An object of the present invention is to provide a component drier which can entirely dry a plurality of components to be dried with high energy efficiency in a short time.

The component drier according to the present invention, which is adapted to dry a plurality of components moistened with a liquid, first comprises a drying chamber. This drying chamber comprises a vat, which is adapted to store components to be dried, having a bottom wall surface allowing passage of air and a liquid. The drying chamber is further provided with a rack for supporting the vat to position the same in a vertical central portion of the drying chamber. The rack has a portion allowing passage of air and a liquid under the bottom surface wall of the vat. The drying chamber is further provided with an air inlet which is positioned before the vat, an air outlet which is positioned beyond the vat, and an openable/closable drain port which is positioned downward beyond the air outlet. Adjacently to the drying chamber, the component drier is further provided with means for forcibly sucking air into the drying chamber through the air inlet, and means for heating air introduced into the drying chamber through the air inlet.

Preferably, the aforementioned suction means is positioned downward beyond the heating means.

Further, the drying chamber is preferably provided on its lower portion with a structure for temporarily storing the liquid to be discharged from the drain port.

Suction ability of the aforementioned suction means is preferably selected to be 2 to 10 times air suppliability through the air inlet.

According to the present invention, most of the liquid moistening the components to be dried can be forcibly removed in the liquid state on the basis of a sucking action by the suction means. Thus, it is possible to reduce the drying time since only a small quantity of the liquid moistening the components at first need be vaporized. Further, it is possible to substantially prevent spotting since the liquid is vaporized in only a small quantity. In addition, it is possible remarkably to save energy which is consumed for drying the components.

The present invention can be employed advantageously for drying electronic components such as ceramic electronic components. Particularly when the component drier according to the present invention is employed for drying electronic components having plated or soldered portions on surfaces thereof, the plated or soldered portions are inhibited from oxidation since it is possible to reduce a time for exposing the components to heat due to reduction of the drying time. Thus, it is possible advantageously to maintain characteristics of the electronic components such as solderability.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
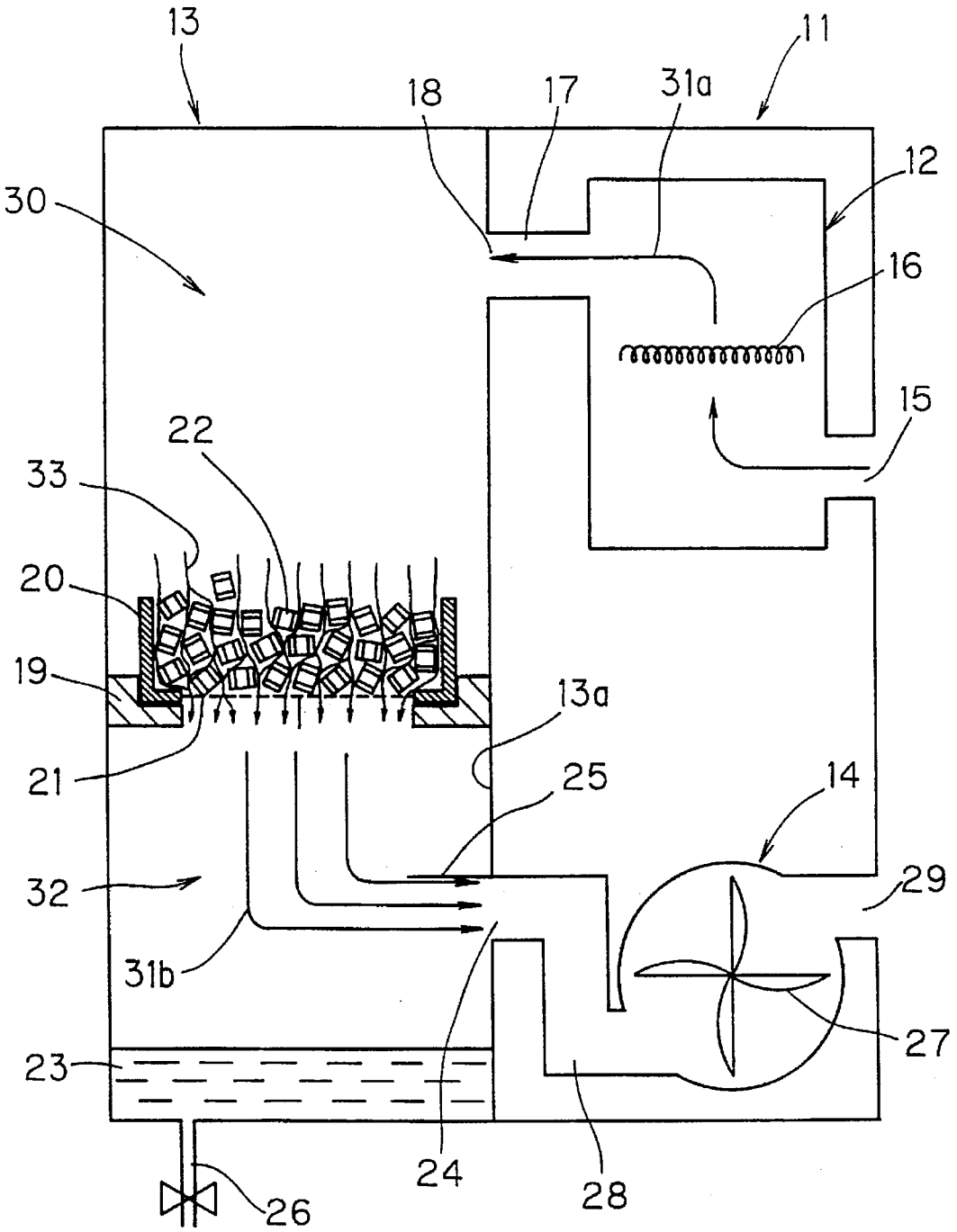
FIG. 1 is an illustrative sectional view showing a component drier 11 according to an embodiment of the present invention.

Referring to FIG. 1, a component drier 11 comprises a hot air generator 12, which is means for supplying hot air, a drying chamber 13 and an aspirator 14, so that the hot air generator 12 is positioned in an upper portion adjacently to the drying chamber 13 while the aspirator 14 is positioned in a lower portion adjacently to the drying chamber 13.

The hot air generator 12 at least comprises an inlet port 15 for absorbing outside air, a heater 16 such as a resistance heater, for example, for heating the air, and a first feed path 17 for feeding the heated air into the drying chamber 13.

The drying chamber 13 is provided in its upper portion with an air inlet 18 which is connected with the first feed path 17. A rack 19 is provided on a vertical central portion of the drying chamber 13, and a vat 20 is arranged on this rack 19. A portion of the rack 19 receiving a bottom surface wall 21 of the vat 20 has a structure allowing passage of the hot air downwardly from above. According to this embodiment, a through hole is formed in a central portion of the rack 19. The vat 20 is adapted to store a plurality of components 22 to be dried, and its bottom surface wall 21 has a structure allowing passage of the hot air. According to this embodiment, the bottom surface wall 21 is formed by a net. An air outlet 24 is provided in an intermediate portion between a lower portion 23 of the drying chamber 13 and the rack 19, and a hood-like projection 25 horizontally extends from a side wall 13*a* of the drying chamber 13 on a portion above the air outlet 24. A drain port 26 is provided in the lowermost portion of the drying chamber 13, for discharging water which is removed from the components 22.

The aspirator 14 comprises a fan 27, a second feed path 28 which is provided on an intake side of the fan 27 and an exhaust port 29 which is provided on an exhaust side of the fan 27, and the second feed path 28 is connected to the air outlet 24. The suction ability of the aspirator 14 is preferably adjustable within a range of up to about 10 times hot air suppliability.

When the component drier 11 having such a structure is driven, the inlet port 15 of the hot air generator 12 sucks the atmospheric air and the heater 16 heats the same, so that the heated air passes through the first feed path 17 and the air inlet 18, to be fed to an upper space 30 of the drying chamber 13 above the rack 19, as shown by arrow 31*a*. On the other hand, moistened hot air moving into a lower space 32 of the drying chamber 13 under the rack 19 passes through the second feed path 28 to be forcibly discharged from the exhaust port 29 along arrows 31*b* by sucking force of the aspirator 14. When the suction ability of the aspirator 14 is set at several times the hot air suppliability, the lower space 32 has a sufficient negative pressure as compared with the upper space 30. As a result, the hot air moves from the upper space 30 into the lower space 32 through clearances between the plurality of components 22 and the bottom surface wall 21 of the vat 20 along arrows 33. At this time, the hot air passes through the narrow clearances between the components 22 along arrows 33 at a relatively high speed. Following such high-speed passage of the hot air, the water moistening the components 22 is separated from the surfaces thereof to form waterdrops, which in turn pass through the lower space 32 to be collected in the lower portion 23 of the drying chamber 13.

In such movement of the hot air along arrows 33 on the basis of suction by the aspirator 14, the water is prevented by the projection 25 which is provided above the air outlet 24 from directly entering the aspirator 14.

When the hot air forcibly passes through the clearances between the components 22 to be dried as described above, about 95% of the water moistening the surfaces of the components 22 is separated from the components 22 with no vaporization, and forms waterdrops which are collected in the lower portion 23 of the drying chamber 13. Therefore, the quantity of the water to be substantially vaporized is reduced to about 5% of the original quantity and the hot air substantially uniformly passes through the clearances between the components 22, whereby it is possible to substantially uniformly dry all components 22 in a short time. On the other hand, the waterdrops collected in the lower portion 23 of the drying chamber 13 are discharged from the drain port 26 as needed.

Figure 2:
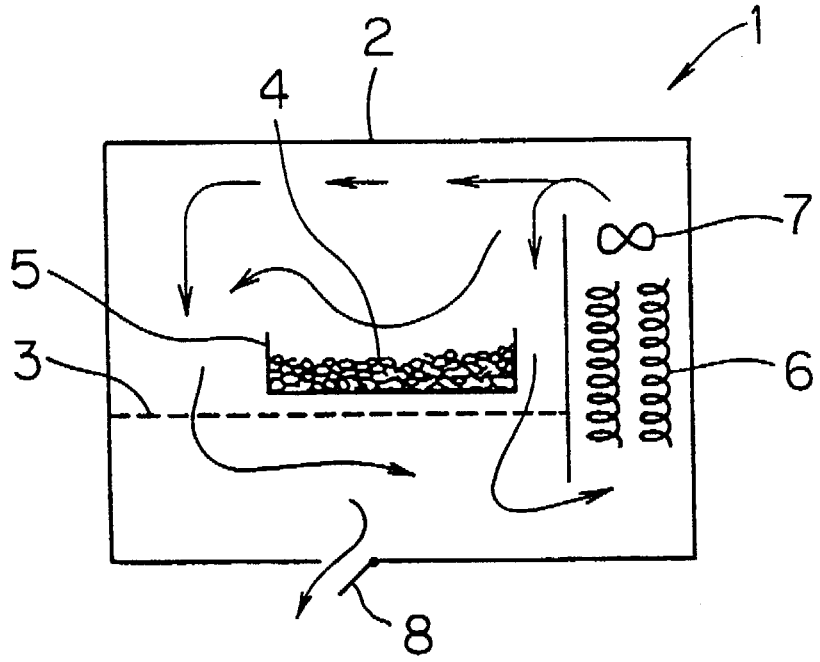
FIG. 2 PRIOR ART
FIG. 2 is an illustrative sectional view showing a conventional component drier 1.

When 50,000 multilayer chip capacitors of 2 mm by 1.25 mm by 0.5 mm which were moistened with water of 100 g and 100,000 inclusions such as metal balls of 1.5 mm in diameter, for example, were dried in practice, the conventional component drier 1 shown in FIG. 2 required a drying time of 60 minutes with hot air of 70° C., while it was possible to complete drying substantially in 5 minutes with hot air of 70° C. in the inventive component drier 11 shown in FIG. 1. At this time, the component drier 11 was set at a hot air quantity of 5 $m^3$ per hour and a suction quantity of 30 $m^3$ per hour.

In the inventive component drier 11, the hot air temperature, the hot air quantity and the suction quantity can be arbitrarily set within ranges of 50° to 200° C., 5 to 10 $m^3$ per hour and 20 to 50 $m^3$ per hour respectively.

According to the component drier 11 shown in FIG. 1, it is also possible to reduce a drying time for an organic solvent of tertiary petroleum such as N-methylpyrrolidone which is hard to dry to not more than 1/10 as compared with the hot air drier 11 shown in FIG. 2.

In the component drier according to the present invention, as hereinabove described, the suction ability in the lower portion of the drying chamber is larger than the hot air suppliability from its upper portion, whereby the lower space of the drying chamber has a negative pressure so that the hot air forcibly passes through the clearances between components to be dried downwardly from above. Thus, substantially most of the water moistening the components can be downwardly separated in the water state. Consequently, only a small part of the water moistening the components may be dried by vaporization, whereby the components are substantially prevented from spotting and the drying time can be remarkably reduced.

Due to such reduction of the drying time, the time for exposing the components to be dried to heat is reduced and hence external electrodes provided on outermost layers of the electronic components are remarkably prevented from oxidation, for example, whereby it is possible to maintain excellent solderability. Further, it is also possible to save considerable energy which is consumed for drying the components.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A component drier for drying a plurality of components being moistened with a liquid comprising:

a drying chamber comprising:

an enclosure having an inside and an outside;

a vat inside said enclosure, said vat being adapted to store components to be dried and having a bottom surface allowing passage of air and a liquid;

a rack, being adapted to support said vat for positioning the same in a vertical central portion of said drying chamber, said vertical central portion being located inside said chamber between an upper space above said rack and a lower space under said rack, said rack having a portion allowing passage of said air and said liquid after passage through said bottom surface of said vat;

an air inlet for passing air into said upper space of said enclosure and being positioned above said vat;

an air outlet for passing air out of said lower space of said enclosure being positioned below said vat; and an openable/closable drain port being positioned below said vat and said air outlet;

a suction device being arranged adjacently to said drying chamber for forcibly sucking air from inside said drying chamber to the outside through said air outlet;

a heating device being arranged adjacently to said drying chamber for heating air being introduced into said drying chamber through said air inlet; and a hood-like member being positioned above said air outlet for preventing said liquid dropping from said vat from entering said air outlet.

2. A component drier in accordance with claim 1, wherein said suction device is arranged for sucking liquid from said components.

3. A component drier for drying a plurality of components being moistened with a liquid comprising:

a drying chamber comprising:

an enclosure having an inside and an outside;

a vat inside said enclosure, said vat being adapted to store components to be dried and having a bottom surface allowing passage of air and a liquid;

a rack, being adapted to support said vat for positioning the same in a vertical central portion of said drying chamber, said vertical central portion being located inside said chamber between an upper space above said rack and a lower space under said rack, said rack having a portion allowing passage of said air and said liquid after passage through said bottom surface of said vat;

an air inlet for passing air into said upper space of said enclosure and being positioned above said vat;

an air outlet for passing air out of said lower space of said enclosure being positioned below said vat; and an openable/closable drain port being positioned below said vat and said air outlet;

a suction device being arranged adjacently to said drying chamber for forcibly sucking air from inside said drying chamber to the outside through said air outlet and forcibly sucking liquid from said components; and a hood-like member being positioned above said air outlet for preventing said liquid dropping from said vat from entering said air outlet.

* * * * *